United States Patent [19]

Yuhara et al.

[11] Patent Number: 4,972,860

[45] **Date of Patent: * Nov. 27, 1990**

[54] VANITY CASE

[75] Inventors: Yukitomo Yuhara, Abiko; Yuji Ideshita, Yokohama, both of Japan

[73] Assignee: Yoshida Industry Co., Ltd., Tokyo, Japan

[ * ] Notice: The portion of the term of this patent subsequent to May 30, 2006 has been disclaimed.

[21] Appl. No.: 177,944

[22] Filed: Apr. 5, 1988

[30] Foreign Application Priority Data

Sep. 11, 1987 [JP] Japan ..... 62-138315
Sep. 11, 1987 [JP] Japan ..... 62-138316

[51] Int. Cl.[5] ..... A45D 42/02

[52] U.S. Cl. ..... 132/301; 220/263; 132/293

[58] Field of Search ..... 132/293, 301, 294, 314, 132/315, 316; 220/281, 263, 264; 206/1.5

[56] References Cited

U.S. PATENT DOCUMENTS

| | | | |
|---|---|---|---|
| 4,276,893 | 7/1981 | Enomoto et al. | 132/301 |
| 4,331,168 | 5/1982 | Hatakeyama | 132/316 |
| 4,366,829 | 1/1983 | Yuhara | 132/301 |
| 4,392,503 | 7/1983 | Watanabe | 206/1.5 |
| 4,399,826 | 8/1983 | Ogasawara | 132/301 |
| 4,474,196 | 10/1984 | Yuhara | 132/301 |
| 4,483,355 | 11/1984 | Yuhara | 132/301 |
| 4,595,028 | 6/1986 | Yuhara | 132/314 |
| 4,679,576 | 7/1987 | Yuhara et al. | 132/293 |
| 4,683,899 | 8/1987 | Yuhara et al. | 132/293 |
| 4,685,558 | 8/1987 | Filiz et al. | 132/301 |
| 4,696,317 | 9/1987 | Shioi et al. | 132/314 |
| 4,834,122 | 5/1989 | Yuhara et al. | 132/301 |

FOREIGN PATENT DOCUMENTS 61-143502 7/1986 Japan .

*Primary Examiner*—Gene Mancene
*Assistant Examiner*—Adriene B. Lepiane
*Attorney, Agent, or Firm*—Wenderoth, Lind & Ponack

[57] ABSTRACT

A vanity case includes a receptacle member, a tray and a cover member all hinged together at the rear ends thereof, and latch members formed on the receptacle member and the cover member for maintaining the tray and the cover member in a closed position. A hole is formed through the marginal portion of the tray for permitting the latch members to engage each other therein, and a cutout is formed in the marginal portion of the receptacle member, the cutout being defined by an inner wall and side walls. A push piece includes an upper end and a body having a lower end, the upper end being secured to the tray in such a manner as to permit at least the body to move inwardly while the body extends downwardly to close the cutout with the lower end abutting the inner wall when the vanity case is in the closed position. A slant surface is formed on at least one of the inner wall and the lower end, whereby a force applied to the body causes the tray and cover member to move upwardly with respect to the receptacle member.

6 Claims, 6 Drawing Sheets

VANITY CASE

BACKGROUND OF THE INVENTION

1. Field of the Invention

The present invention relates to a vanity case of the type in which a receptacle member, a tray and a cover member are hinged together at respective rear ends thereof and the tray and cover member are maintained in closed position with respect to the receptacle member by engagement of latch means formed on the front ends of the cover and receptacle members.

2. Description of the Prior Art

Various attempts and efforts have hitherto been made in order to facilitate an opening operation of the cover member, and a push piece has been proposed and found effective. For example, U.S. Pat. No. 4,276,893 and U.S. Pat. No. 4,399,836 disclose such a push piece arranged in a recess formed on the marginal portion of the receptacle member in a slidable manner (U.S. Pat. No. 4,276,893) or in a rotatable manner (U.S. Pat. No. 4,399,826) so that an inwardly directed pressure applied to the push piece urges the cover member upwardly to thereby release the engagement of latch means. In order to open the cover member, the push piece is pressed by, for example, the thumb of one hand, which releases the engagement of the latch means. Then the front end of cover member is lifted by using the other hand or by shifting the thumb to the front edge of the cover. It is thus necessary to use both hands or to do a two-step operation in opening the cover.

U.S. Pat. No. 4,331,168 discloses an arrangement of the push piece in the cover member, whereby the cover member can be opened by the same finger which has pressed the push piece. In this vanity case, however, a portion of the push piece to be pressed is located just above the upper edge of the receptacle member so that the lower end of the finger which has pressed the push piece tends to come into contact with the upper edge of receptacle, resulting in a difficulty in lifting up the cover by the same finger without shifting such finger. In order to avoid such contact a delicate operation or manipulation is required in positioning the finger onto the push piece.

Also, it is known in the art to provide a tray between the receptacle and cover members for enabling a vanity case to accommodate a puff in addition to the cosmetic material. An example of such "three part" type vanity case is disclosed in Japanese Utility Model KOKAI No. 61-143502 in which the tray as well as the cover is hinged with the receptacle at the rear ends thereof. A push piece is arranged in the tray and adapted to release dual engagements between latch members of the cover member and the tray and between latch members of the tray and the receptacle member. The push piece is mounted in the tray and projects forwardly beyond the front edge of the vanity case in order to permit a user to press the push piece without a delicate operation. Such a projecting push piece, however, not only spoils the esthetic external appearance of the vanity case but also involves a disadvantage that the cover may be opened accidentally.

Accordingly, an object of the present invention is to provide a vanity case having a push piece which can be pressed by a user's finger without delicate positioning of the finger.

Another object of the invention is to provide a vanity case in which a cover member can be opened to a desired angle by the same finger employed for pressing the push piece to achieve unlatching without shifting such finger.

SUMMARY OF THE INVENTION

According to the present invention, a vanity case includes a receptacle member, a tray disposed on the receptacle member and hinged therewith at the rear end thereof, and a cover member disposed on the tray and hinged with the receptacle member at the rear end thereof. A first lug extends from the upper surface of the receptacle member to provide a first latch member thereon, while a second lug extends from the lower surface of the cover member to provide a second latch member thereon, these first and second latch members being adapted to engage with each other to thereby maintain the cover member and the tray in a closed position with respect to the receptacle member. A hole is formed in the marginal portion of the tray for permitting the first and second lugs to enter therein, and a cutout is formed in the marginal portion of the receptacle member and is defined by an inner wall and side walls. Provided for releasing the engagement of the latch members is a push piece which includes an upper end and a body having a lower end, the upper end being secured to the tray in such a manner as to permit at least the body to move inwardly while the body extends downwardly to close the cutout with the lower end abutting the inner wall when the vanity case is in the closed position. A slant surface is formed on at least one of the inner wall and the lower end, whereby an inwardly directed force applied to the body causes the tray and the cover member to move upwardly with respect to the receptacle member.

Other objects, features and advantages of the invention will be apparent from the following detailed description thereof when taken in conjunction with the accompanying drawings.

DETAILED DESCRIPTION OF THE INVENTION

Figure 1:
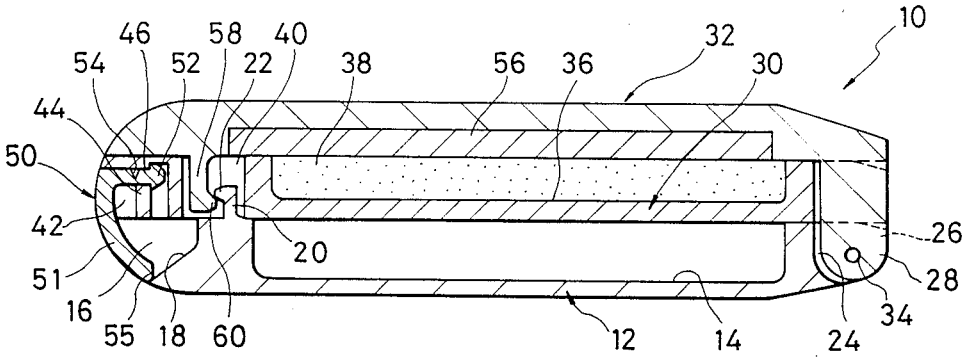
FIG. 1 is a longitudinally sectioned view of a vanity case according to a first embodiment of the present invention, showing a closed position thereof.

Referring first to FIGS. 1 to 5 of the drawings, a vanity, case 10 comprises a receptacle member 12 having formed in the upper surface thereof a concave portion for containing a cosmetic utensil such as a puff. In the central portion of the front end of the receptacle 12 is formed a cutout 16 which opens onto the upper surface, front end, and underside. Thus, the cutout 16 is defined by a pair of side walls and an inner wall comprising an upper vertical surface and a lower slant surface 18 descending toward the front end. A first lug 20 extends upward from the upper surface of the receptacle 12 at a position adjacent the inner wall of the cutout 16, and a first latch tongue 22 is formed at the top end of the lug 20 and faces forwardly. In the center of the rear end of the receptacle 12 is formed a groove 24 into which are fitted hinge pieces 26 and 28 of a tray 30 and a cover member 32, respectively, and the hinge pieces 26 and 28 are hinged with the receptacle 12 by a pin 34.

The tray 30, generally of a rectangular shape in plan view, has a concave portion 36 for containing cosmetic material 38. A hole 40 is bored through the thickness of the tray 30 at the center of the front marginal portion thereof in order to permit the first lug 20 to extend into the hole 40 when the tray 30 is closed over the receptacle 12. The lower surface of the front end of tray 30 is centrally cut away to provide a recess 42 which is separated from the hole 40 by a wall 41 and which is divided by a bar 44 into an outer or front part and an inner or rear part. The bar 44 extends between side walls defining the recess 42 to delimit in cooperation with the upper surface of the recess a gap 46 through which the outer and inner parts of the recess 42 communicate with each other. The inner part is enlarged by a step 48 formed on the upper surface of the recess adjacent the gap 46.

Figure 2:
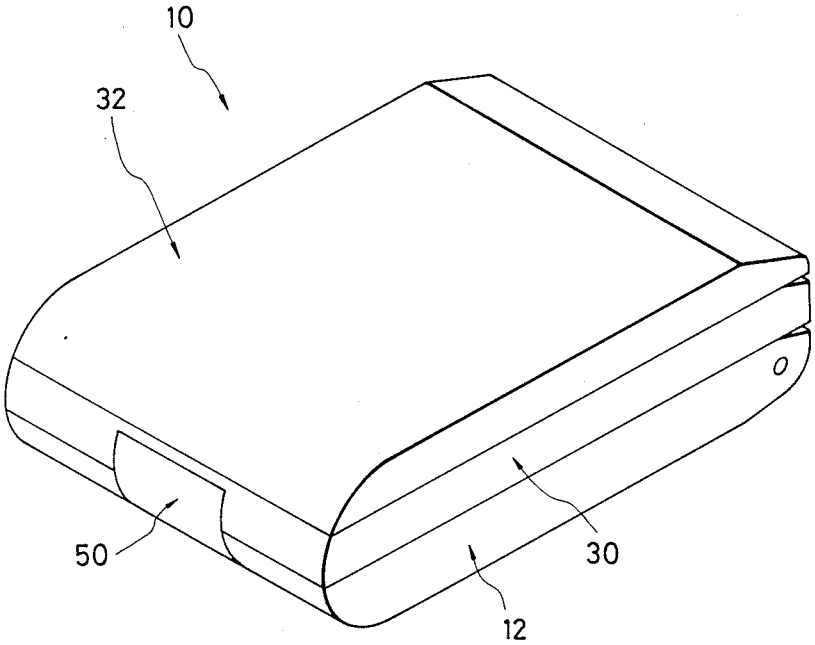
FIG. 2 is a perspective view of the vanity case of FIG. 1.
Figure 3:
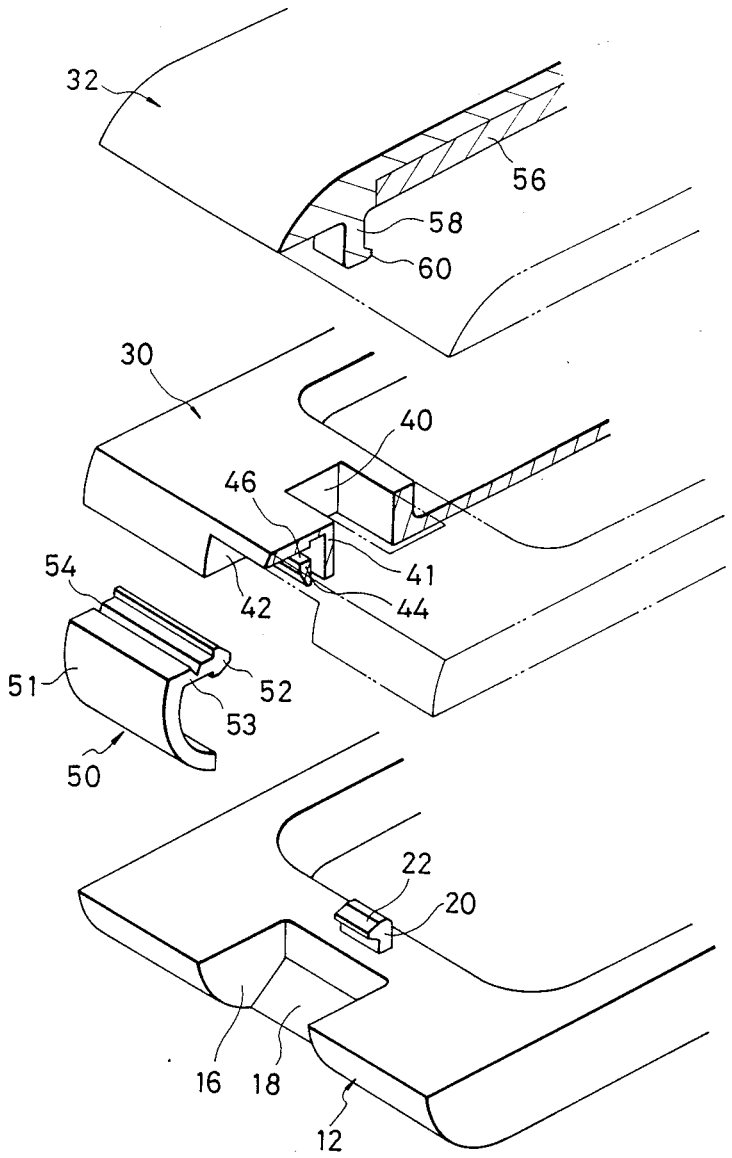
FIG. 3 is an exploded perspective view showing the front part of the vanity case.

A head 52, in the form of an arrow in cross section, of a push piece 50 is forcedly inserted into the inner part of recess 42 through the gap 46 and is engaged with the step 48 to thereby secure the push piece 50 to the tray 30. The push piece 50 includes a rounded body 51 the upper end of which is connected to the head 52 via a flat portion 53. The entire push piece 50 is integrally molded of plastic material having sufficient flexibility so that a notch 54 on the flat portion 53 permits the rounded body 51 to swing or pivot or pivot when a pressure is applied to the latter. The rounded body 51 extends generally downwardly in such a manner that it closes the recess 42 of tray 30 and the cutout 16 of receptacle 12, and that the lower end 55 of body 51 abuts and rests on the lower edge of slant surface 18 of the cutout 16. The body 51 has the same curvature as the front end walls of the tray 30 and receptacle 12 in order to make the outer surface of the body 51 flush with such end walls, as illustrated in FIG. 2.

A mirror 56 is adhered to the lower surface of the cover 32. A second lug 58 extends downward from the front part of the cover 32, and a second latch tongue 60 projects inward from the lower end of this second lug 58. When the cover 32 is closed over the receptacle 12, this second lug 58 enters the hole 40 of the tray 30 to engage the second latch tongue 60 with the first latch tongue 22, thereby maintaining the cover 32 in the closed position with the tray 30 between cover 32 and the receptacle 12.

Figure 4:
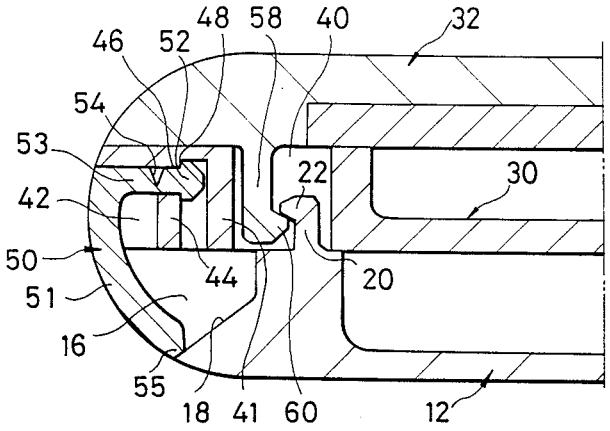
FIG. 4 is a fragmentary sectional view thereof in the closed position.
Figure 5:
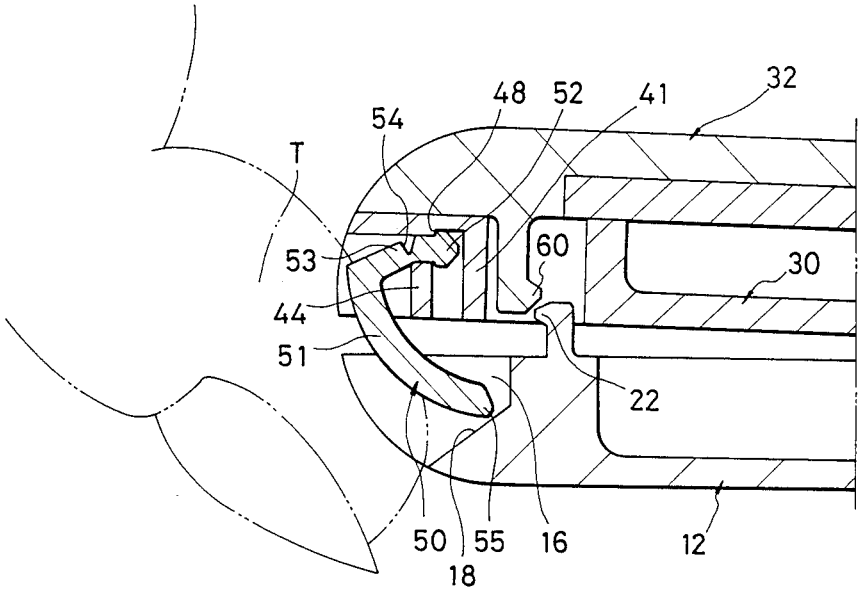
FIG. 5 is a view similar to FIG. 4 and showing operation of a push piece.

In order to open the vanity case 10 from the closed position as shown in FIGS. 1 and 4, the body 51 of the push piece 50 is pressed in an upward and rearward direction with a finger such as a thumb T, which causes the body 51 to swing inward about the notch 54 with its lower end 55 sliding on the slant surface 18. As the lower end 55 slides up on the slant surface 18, upward force is applied to the tray 30, to which the push piece 50 is secured, and ultimately to the cover 32 disposed on the tray 30 so that the second latch tongue 60 is disengaged from the first latch tongue 22 to release the lock of the cover 32, as shown in FIG. 5. Then, the force is continuously applied to the push piece 50 with the same finger in the same direction until the tray 30 and the cover 32 are opened to a desired angle. Thereafter, as the cover 32 is disposed on the tray 30 without engagement, it can be lifted up easily with respect to the tray 30 by, for example, holding the side ends of the cover with two fingers.

When the force applied onto the push piece 50 is removed, the body 51 swings backward to its original position, thus closing the cover 32 as well as the tray 30 over the receptacle 12, and causes the second latch tongue 60 to engage with the first latch tongue 22, whereby the cover 32 together with the tray 30 is maintained in the closed position.

During the above opening operation, a user may first put her finger onto the front end of the body 51 and then apply the end of that finger to the lower portion of the body. Since the body 51 extends substantially throughout the thickness of the tray 30 and the receptacle 12, no delicate manipulation is required to locate the finger in position. In addition, the pressure required for releasing the engagement between the latch tongues 22 and 60 works substantially in the same direction as the force for raising the tray 30 and the cover 32, which eliminates shifting the user's fingers or changing the direction of pressure applied to the push piece.

In the illustrated embodiment the body 51 of the push piece 50 has the rounded shape so as to coordinate with the rounded end of the vanity case. If the vanity case is desired to have an angular shape, the push piece may include a vertical body perpendicular to the flat portion 53. Also, a lower end of the body may include a slant surface instead of or in addition to the slant surface 18 of the cutout 16.

Figure 6:
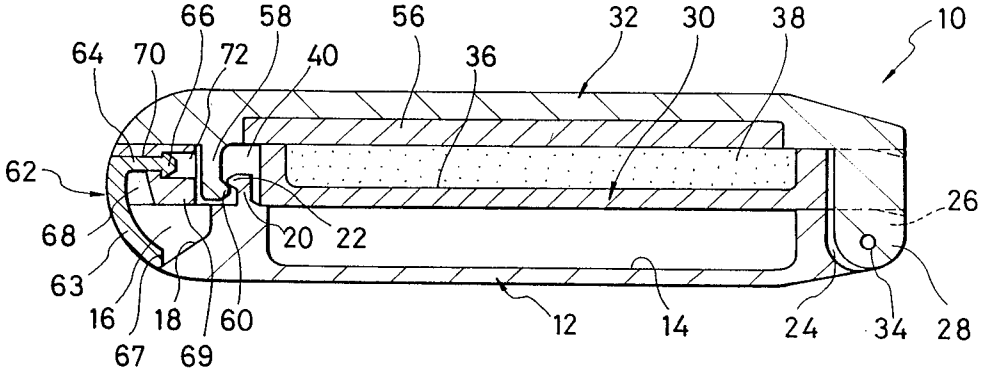
FIG. 6 is a longitudinally sectioned view of a vanity case according to a second embodiment of the present invention in a closed position.
Figure 7:
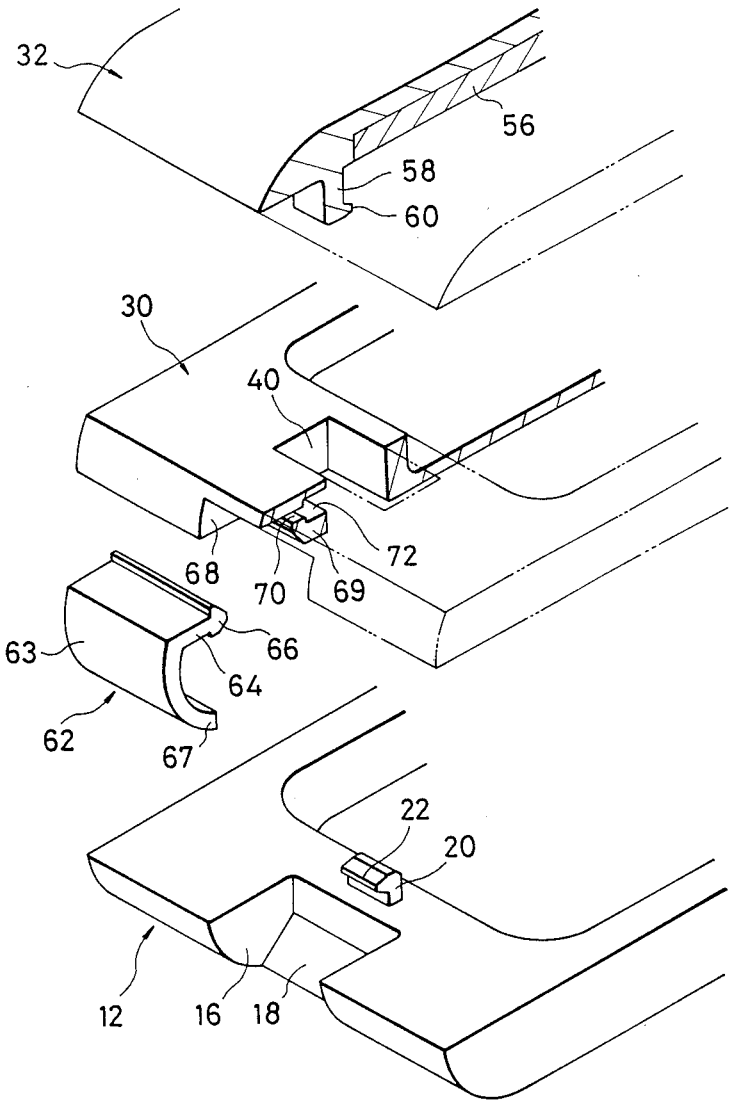
FIG. 7 is an exploded perspective view showing the front part of the vanity case of FIG. 6.
Figure 8:
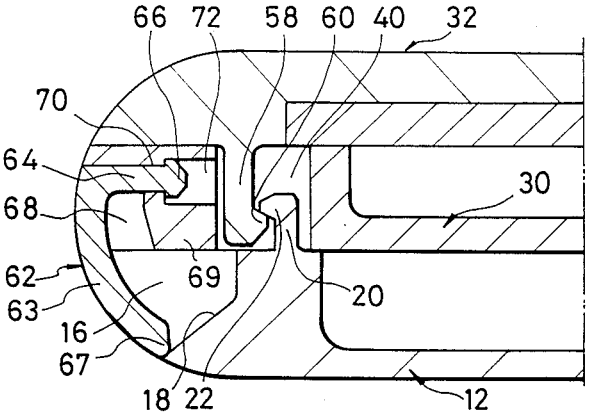
FIG. 8 is a fragmentary sectional view thereof.

FIGS. 6 to 9 illustrate another embodiment of the invention, in which the same reference numerals are used to indicate parts the same as or corresponding to those in the above embodiment. A push piece 62 in this embodiment is formed of a relatively stiff plastic material and includes a horizontal portion 64 of uniform section, i.e. without notch, and an enlarged head 66 provided at the inner end of the portion 64. An inner end of a recess 68 of the tray 30 is defined by a bar 69 extending between the side walls that also define the recess. The upper end of the bar 69 cooperates with the upper surface of the recess 68 to delimit a gap 70 through which the recess communicates with the hole 40. The inner portion 72 of the gap 70 is enlarged by steps and has a length sufficient to ensure a sliding movement of the push piece head 66 within the portion 72, while the outer end portion of the gap 70 permits the horizontal portion 64 to fit therein in a slidable manner. When the push piece 62 is in the forward position as shown in FIGS. 6 and 8, the head 66 is engaged with the steps and is prevented from being removed from the inner portion 72. The push piece 62 further comprises a rounded body 63 extending generally downwardly from the horizontal portion 64 to close the recess 68 and the cutout 16 with its lower end 67 being in contact with the lower edge of the slant surface 18, as in the first embodiment.

Figure 9:
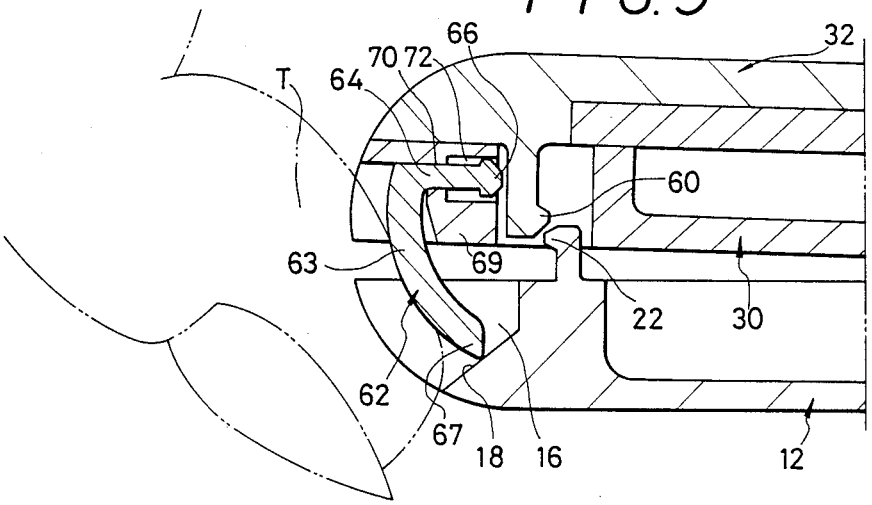
FIG. 9 is a similar view to FIG. 8 showing an operation of a push piece.

When it is desired to open the vanity case from its closed position of FIGS. 6 and 8, a user first puts her finger such as the thumb T on the rounded body 63 and then applies an inwardly directed force thereto through that finger. Such a force causes the horizontal portion 64 and the head 66 to slide inwardly in the gap 70 and its inner portion 72, and the lower end 67 of the body 63 to slide along the slant surface 18. As the lower end 67 slides up on the slant surface 18, upward force is applied to the tray 30, to which the push piece 62 is secured, and ultimately to the cover 32 so that the second latch tongue 60 is disengaged from the first latch tongue 22 to slightly open the tray 30 and cover 32 as shown in FIG. 9. Then, these parts are opened to any desired angle simply by changing the direction of force applied to the push piece 62 without interference with or by the receptacle 12. Thereafter, the cover 32 is opened with respect to the tray 30 in the same manner as in the first embodiment.

Although the present invention has been described with reference to the preferred embodiments thereof, many modifications and alterations may be made within the spirit of the invention.

What is claimed is:

1. A vanity case comprising:

a receptacle member;

a tray disposed on said receptacle member and hinged therewith at rear ends thereof;

a cover member disposed on said tray and hinged with said receptacle member at rear ends thereof, said cover member having a marginal portion;

a first lug extending from the upper surface of said receptacle member;

a first latch member formed on said first lug;

a second lug extending from the lower surface of said cover member;

a second latch member formed on said second lug;

said first and second latch members adapted to engage with each other to thereby maintain said cover member and said tray in a closed position with respect to said receptacle member;

a hole formed through a marginal portion of the tray for permitting said first and second lugs to enter therein;

a cutout formed in a marginal portion of said receptacle member, said cutout opening onto the upper surface, the front end and the underside of said receptacle member and being defined by an inner wall and side walls, said inner wall comprising an upper vertical surface and a lower slant surface inclined forwardly and downwardly toward a front end thereof; and a push piece for releasing the engagement of said latch members, said push piece including an upper end and a body having a lower end, said upper end being connected to said tray in such a manner as to permit at least said body to move inwardly, and said body extending downwardly to close said cutout with said lower end abutting said lower slant surface of said inner wall when the vanity case is in said closed position, said body of said push piece and said marginal portions of said cover and receptacle members having equal curvatures such that the outer surface of said body is flush with outer surfaces of said marginal portions of said cover and receptacle members when said cover member is in said closed position;

whereby an inwardly directed pressure applied to said body causes said tray and said cover member to move upwardly with respect to said receptacle member.

2. A vanity case as claimed in claim 1, further comprising a recess formed in said tray at a position corresponding to said cutout of said receptacle member, and wherein said upper end of said push piece is accommodated in said recess.

3. A vanity case as claimed in claim 2, wherein said upper end of said push piece is fixedly secured within said recess and wherein said upper end includes a notch for affording flexibility thereto and thereby permitting a swing movement of said body.

4. A vanity case as claimed in claim 3, further comprising a bar extending between side walls defining said recess and a step formed the upper surface of said recess, and wherein said upper end of said push piece further includes an enlarged head engaging with said bar and said step.

5. A vanity case as claimed in claim 2, wherein said upper end of said push piece is slidably fitted in said recess for permitting a sliding movement of said push piece.

6. A vanity case as claimed in claim 5, further comprising a bar extending between side walls of said recess to define in cooperation with the upper surface of said recess a gap having an enlarged inner portion, and wherein said upper end of said push piece includes an enlarged head slidably fitted in said inner portion of said gap.

* * * * *